US006174638B1

(12) United States Patent
Ishigami et al.

(10) Patent No.: US 6,174,638 B1
(45) Date of Patent: Jan. 16, 2001

(54) NAPHTHALENETETRACARBOXYLIC ACID DIIMIDE DERIVATIVES AND PHOTOSENSITIVE MATERIALS FOR ELECTROPHOTOGRAPHY

(75) Inventors: Kou Ishigami, Mishima; Fumio Sugai; Yasufumi Mizuta, both of Chuo-ku, all of (JP)

(73) Assignee: Kyocera Mita Corporation, Osaka (JP)

( * ) Notice: Under 35 U.S.C. 154(b), the term of this patent shall be extended for 0 days.

(21) Appl. No.: 09/320,562

(22) Filed: May 27, 1999

(30) Foreign Application Priority Data

May 28, 1998 (JP) ..... 10-148058

(51) Int. Cl.[7] ..... G03G 5/06
(52) U.S. Cl. ..... 430/78; 430/83
(58) Field of Search ..... 430/58.65, 58.75, 430/78, 83; 546/70

(56) References Cited

U.S. PATENT DOCUMENTS

| | | | | |
|---|---|---|---|---|
| 1,935,945 | * | 11/1933 | Eckert et al. | 546/70 |
| 4,514,482 | * | 4/1985 | Loutfy et al. | 430/78 |
| 4,992,349 | * | 2/1991 | Chen et al. | 430/38 |
| 5,266,429 | * | 11/1993 | Sorriero et al. | 430/58 |
| 5,952,140 | * | 9/1999 | Visser et al. | 430/59 |

* cited by examiner

*Primary Examiner*—John Goodrow

(57) ABSTRACT

Naphthalenetetracarboxylic acid diimide derivatives represented by the general formula (1), (1)

wherein m and n are integers inclusive of 0 but not larger than 6, and are different from each other, R1 is a hydrogen atom, an alkyl group, an alkoxyl group or a halogen atom, either one of R2 or R3 is a substituted or unsubstituted aryl group, and the other one is an alkyl group, an alkoxyl group or an amino group, and wherein when R2 or R3 is an alkoxyl group or an amino group, the number n or m of methylene chains to which this group is bonded is not zero.

The derivatives exhibit excellent solubility in an organic solvent, excellent compatibility with a resin binder and excellent photosensitivity, and are very useful as an electron-transporting agent for the photosensitive material for electrophotography.

21 Claims, 4 Drawing Sheets

NAPHTHALENETETRACARBOXYLIC ACID DIIMIDE DERIVATIVES AND PHOTOSENSITIVE MATERIALS FOR ELECTROPHOTOGRAPHY

BACKGROUND OF THE INVENTION

1. Field of the Invention

The present invention relates to non-symmetrical naphthalenetetracarboxylic acid diimide derivatives and to a photosensitive material for electrophotography which contains a naphthalenetetracarboxylic acid diimide derivative as an electron transporting agent and is used for the electrophotographic copy, printer and common paper facsimile.

2. Description of the Prior Art

In an electrophotographic method, an electrophotosensitive material is electrically charged and is exposed to image-bearing light to form an electrostatic latent image which is, then, developed into a toner image in a state where a developing bias voltage is applied, and the formed toner image is transferred onto a transfer paper or the like paper and is fixed to form an image. This electrophotographic method is extensively used for the digital or analog copy, printer and common paper facsimile.

A selenium photosensitive material and an amorphous silicon photosensitive material have heretofore been used for the electrophotography. In recent years, however, an organic photosensitive material (OPC) has also been extensively used. Representative examples of the organic photosensitive material include a laminated-layer photosensitive material of the separated function type in which a charge-generating agent (CGM) and a charge-transporting agent (CTM) are laminated one upon the other as separate layers, and a single-layer photosensitive material in which the CGM and the CTM are formed as a single dispersion layer.

As the charge-generating agent, there have been known a variety of inorganic or organic charge-generating agents such as selenium, selenium-tellurium, amorphous silicon, pyrylium salt, azo pigment, disazo pigment, trisazo pigment, anthanthrone pigment, phthalocyanine pigment, indigo pigment, threne pigment, toluidine pigment, pyrazoline pigment, pyranthrone pigment, perylene pigment and quinacridone pigment. As the charge-transporting agent, there have been known positive hole-transporting agents such as poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, p-diethylaminobenzaldehyde-(diphenylhydrazone), tetra(m-methylphenyl) methaphenylenediamine, N,N,N',N'-tetraphenylbenzidine derivative, N,N'-diphenyl-N,N'-dixylylbenzidine, as well as electron-transporting agents such as 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitroanthracene, dinitroacridine, dinitroanthraquinone, naphthoquinones, and 3,5-dimethyl-3',5'-di-t-butyldiphenoquinone.

U.S. Pat. No. 4,442,193 discloses a photoconducting composition containing a photoconducting material and a 1,4,5,8-naphthalenebisdicarboxyimide derivative sensitizing compound.

U.S. Pat. No. 5,468,583 discloses a photoconducting element comprising an electrically conducting layer, a charge-generating layer and an electron-transporting agent in a polymeric binder layer, wherein the electron-transporting agent comprises at least one kind of a cyclic bisdicarboxyimide represented by the following formula (2), (2)

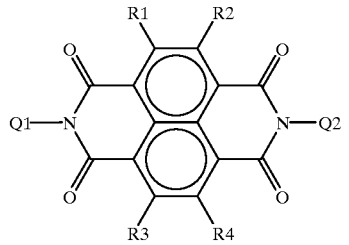

wherein Q1 and Q2 may be the same or different and are each a branched-chain alkyl group, an unsubstituted straight-chain alkyl group, an unsubstituted cyclic alkyl group, an alkyl-substituted cyclic alkyl group, an unsubstituted straight-chain unsaturated alkyl group, an aryl group, an alkyl group having 2 to 20 carbon atoms, an alkoxyl group or a hydrogen atom, and wherein Q1 and Q2 are not hydrogen atoms simultaneously, and R1, R2, R3 and R4 may be the same or different and are each a hydrogen atom, an alkyl group having 1 to 4 carbon atoms, an alkoxyl group having 1 to 4 carbon atoms, or a halogen atom.

Japanese Examined Patent Publication (Kokoku) No. 39098/1989 discloses an electric semiconductor or a photoconductor comprising naphthalenetetracarboxylic acid diimides represented by the following formula (3)

(3)

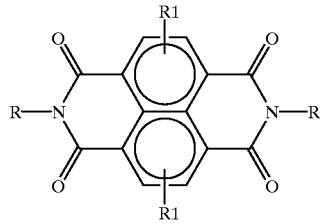

wherein R is a saturated or olefinically unsaturated aliphatic or alicyclic group which includes an electron-donating group, and R1, independently from each other, is a hydrogen atom, an alkyl group having 1 to 4 carbon atoms, a halogen atom, $NO_2$, $SO_3H$, CN, $COOR_2$, $NR_2$ (wherein $R_2$ is a hydrogen atom or an alkyl group having 1 to 4 carbon atoms), a hydroxyl group or an alkoxyl group having 1 to 4 carbon atoms.

Among the charge-transporting agents, however, very few electron-transporting agents are satisfying a practicable level, and further improvement in the performance is desired even with respect to photosensitivity.

The naphthalenetetracarboxylic acid diimide derivative is a promising compound as an electron-transporting agent but is not still satisfactory concerning solubility in an organic solvent and compatibility with a resin binder that is used, and tends to be precipitated in the form of crystals in the photosensitive layer and in the electron-transporting layer, deteriorating the electrophotographic properties of the photosensitive material.

When used at a concentration that maintains compatibility with the resin, furthermore, the naphthalenetetracarboxylic acid diimide derivative exhibits insufficient photosensitivity. It is therefore desired to increase its photosensitivity.

SUMMARY OF THE INVENTION

The present inventors have forwarded the study concerning the naphthalenetetracarboxylic acid diimide derivatives that exhibit excellent solubility in an organic solvent, excellent compatibility with a resin binder that is used, and enhanced photosensitivity, and have succeeded in synthesizing asymmetrical naphthalenetetracarboxylic acid diimide derivatives that will be described below in detail and have discovered the fact that the asymmetrical naphthalenetetracarboxylic acid diimide derivatives exhibit excellent properties satisfying the above-mentioned requirements.

It is therefore an object of the present invention to provide naphthalenetetracarboxylic acid diimide derivatives that exhibit excellent solubility in an organic solvent, excellent compatibility with a resin binder that is used, and excellent photosensitivity.

Another object of the present invention is to provide an organic photosensitive material for electrophotography containing a novel electron-transporting agent and having a high photosensitivity and a low residual potential and, as a result, capable of stably forming a highly dense vivid image without background fogging for extended periods of time.

According to the present invention, there is provided naphthalenetetracarboxylic acid diimide derivatives represented by the general formula (1), (1)

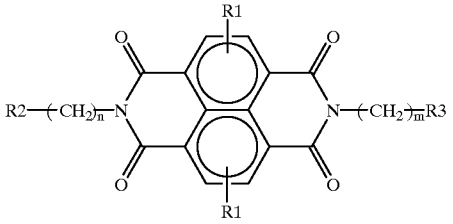

wherein m and n are integers inclusive of 0 but not larger than 6, and are different from each other, R1 is a hydrogen atom, an alkyl group, an alkoxyl group or a halogen atom, either one of R2 or R3 is a substituted or unsubstituted aryl group, and the other one is an alkyl group, an alkoxyl group or an amino group, and wherein when R2 or R3 is an alkoxyl group or an amino group, the number n or m of methylene chains to which this group is bonded is not zero.

According to the present invention, furthermore, there is provided a photosensitive material for electrophotography containing the above-mentioned naphthalenetetracarboxylic acid diimide derivatives.

It is desired that the photosensitive material for electrophotography further contains an electron acceptor in addition to the naphthalenetetracarboxylic acid diimide derivatives.

DETAILED DESCRIPTION OF THE INVENTION

Figure 1:
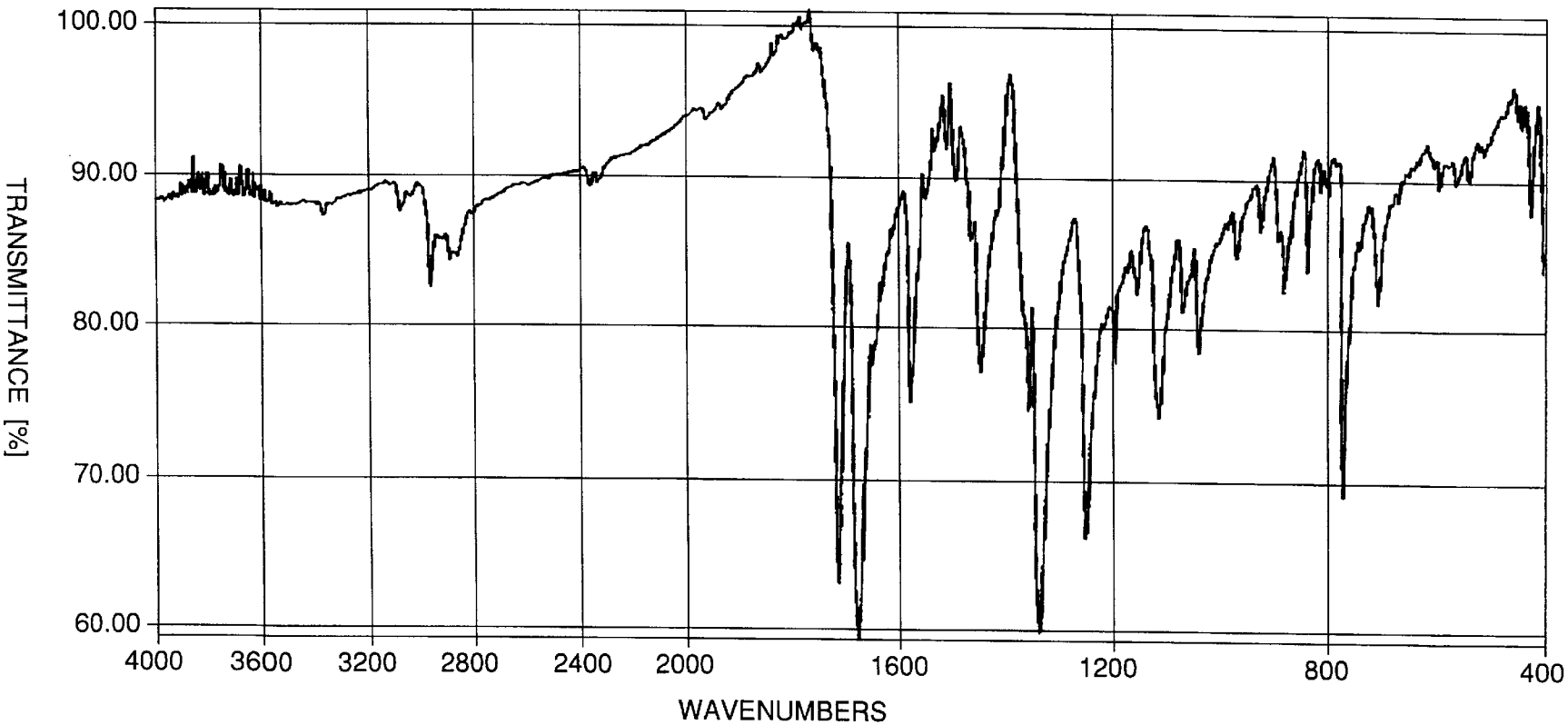
FIG. 1 shows an infrared-ray absorption spectrum of a naphthalenetetracarboxylic acid diimide derivative (Synthesis Example 1) according to the present invention.

A naphthalenetetracarboxylic acid diimide derivative of the present invention has a structural feature in that a substituent bonded to a nitrogen atom on one side of a 1,4,5,8-naphthalenetetracarboxylic acid diimide skeleton is not symmetrical to a substituent bonded to a nitrogen atom on the other side as well as a feature in that one substituent is aromatic and another substituent is aliphatic.

Reference should be made to Examples appearing later. That is, in Examples appearing later, a post-exposure potential (the smaller the potential, the higher the sensitivity) of after the photosensitive material containing a charge-generating agent and an electron-transporting agent is irradiated with a ray of light of a predetermined optical intensity for a predetermined period of time, is used as an index of photosensitivity in order to evaluate the photosensitivity as well as to evaluate the presence of crystallization when the photosensitive material is blended in a resin.

The results teach unexpected facts that the naphthalenetetracarboxylic acid diimide derivatives of the present invention are crystallized in greatly suppressed amounts in the resin and exhibit strikingly increased photosensitivity compared with bis(N,N'-2-ethoxyethyl) naphthalenetetracarboxylic acid diimides.

According to the photosensitive material of the present invention, furthermore, the residual potential after the exposure to light is lowered, making it possible to form a charge image maintaining a high contrast as well as to stably form images with little background fogging for extended periods of time without disadvantage caused by the accumulation of electric charge.

[Naphthalenetetracarboxylic Acid Diimide Derivatives]

The naphthalenetetracarboxylic acid diimide derivatives used in the present invention have a chemical structure expressed by the following formula (substantially the same as the above-mentioned formula (4)

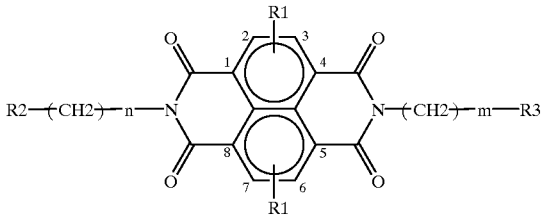

In this derivative, the number of methylene chains bonded to a nitrogen atom on one side of the naphthalenetetracarboxylic acid diimide skeleton is different from the number of methylene chains bonded to a nitrogen atom on the other side (either one of them could be zero). Besides, as for the groups bonded through the methylene chains or directly bonded, the group on one side is a substituted or unsubstituted aryl group and the group on the other side is an alkyl group, an alkoxyl group or an amino group, making the structure asymmetrical to a considerable degree. It is believed that due to this asymmetrical structure, the naphthalenetetracarboxylic acid diimide derivatives of the present invention exhibit excellent solubility in an organic solvent and excellent compatibility in a resin, and are contributing to increasing the light-absorbing efficiency and increasing the electron-transporting property.

The numbers n and m of methylene chains in the compound are not larger than 6 and could be zero, and are different from each other. That is, between the group R2 or R3 and the nitrogen atom, there exists, for example, a direct bond, a methylene group, an ethylene group, a 1,3-propylene group, a 1,4-butylene group, a 1,5-pentylene group or a 1,6-hexylene group.

In the formula (4), R1 is a hydrogen atom, an alkyl group, an alkoxyl group or a halogen atom. Examples of the alkyl group are those having 1 to 6 carbon atoms, such as methyl group, ethyl group, n-propyl group, iso-propyl group, n-butyl group, iso-butyl group, t-butyl group, amyl group and 2-ethylhexyl group. Examples of the alkoxyl group include methoxy group, ethoxy group, propoxy group and butoxy group. Examples of halogen atom include chlorine atom, bromine atom, etc.

Either R2 or R3 is a substituted or unsubstituted aryl group, and the other one is an alkyl group, an alkoxyl group or an amino group.

Examples of the aryl group include a phenyl group and a naphthyl group which may not be substituted or substituted with an alkyl group, an alkoxyl group or a halogen atom, and wherein the substituents may be those described above concerning the group R1.

As the other alkyl group R2 or R3, there can be exemplified those having 1 to 6 carbon atoms as groups including a methylene group bonded to the nitrogen atom, such as methyl group, ethyl group, n-propyl group, iso-propyl group, n-butyl group, iso-butyl group, t-butyl group, amyl group and 2-ethylhexyl group. As the alkoxyl group, there can be exemplified those having 1 to 6 carbon atoms, such as methoxy group, ethoxy group, n- or iso-propoxy group, n-, iso- or t-butoxy group and 2-(ethoxy)ethoxy group. As the amino group, there can be exemplified secondary or tertiary amino groups, such as methylamino group, ethylamino group, N-ethylamino-ethylamino group, dimethylamino group, diethylamino group, piperadino group, piperidino group and morpholino group.

Here, when R2 or R3 is an alkoxyl group or an amino group, it is necessary that the number n or m of methylene chains to which this group is bonded is not zero and, is particularly, not smaller than 2.

When the group R2 or R3 is an aryl group, it is desired that the number n or m of methylene chains to which this group is bonded is zero. It is desired that the aryl group is a phenyl group and has one to three alkyl groups as substituents.

Concrete examples of the asymmetrical naphthalenetetracarboxylic acid diimide derivative are as follows:

N-(2-ethoxyethyl)-N'-(2-methyl-6-ethylphenyl) naphthalene-1,4,5,8-tetracarboxylic acid diimide, N-(2-ethoxymethyl)-N'-(2-methyl-6-ethylphenyl) naphthalene-1,4,5,8-tetracarboxylic acid diimide, N-(2-ethoxyethyl)-N'-phenylnaphthalene-1,4,5,8-tetracarboxylic acid diimide, N-(2-ethoxyethyl)-N'-(2,6-dimethyl-4-ethylphenyl) naphthalene-1,4,5,8-tetracarboxylic acid diimide, N-(2-ethoxyethyl)-N'-(2-methyl-4-t-butylphenyl) naphthalene-1,4,5,8-tetracarboxylic acid diimide, N-(dimethylaminoethyl)-N'-(2-methyl-6-ethylphenyl) naphthalene-1,4,5,8-tetracarboxylic acid diimide, N-(diethylaminoethyl)-N'-(2-methyl-6-ethylphenyl) naphthalene-1,4,5,8-tetracarboxylic acid diimide, N-(2-ethylhexyl)-N'-(2-methyl-6-ethylphenyl) naphthalene-1,4,5,8-tetracarboxylic acid diimide, and N-amyl-N'-(2-methyl-6-ethylphenyl)naphthalene-1,4,5,8-tetracarboxylic acid diimide.

The naphthalenetetracarboxylic acid diimide derivatives used in the present invention are in no way limited to the above-mentioned examples only, as a matter of course.

The above-mentioned naphthalenetetracarboxylic acid diimide derivative is synthesized by reacting a naphthalenetetracarboxylic acid anhydride represented by the following formula (5), (5)

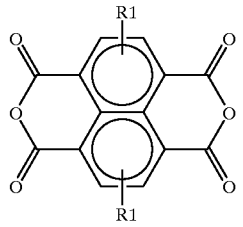

with primary amines represented by the following formula (6), $$R_2\text{-}(CH_2)_n\text{-}NH_2 \quad (6)$$

and with primary amines represented by the following formula (7), $$R_3\text{-}(CH_2)_m\text{-}NH_2 \quad (7)$$

under a refluxing condition.

The primary amines of the formula (6) and the primary amines of the formula (7) may be fed in the form of a mixture to the reaction system, or may be successively fed to the reaction system in order to form a diimide passing through a half-imide.

As the solvent, it is desired to use a nonprotonic polar organic solvent such as dimethylformamide or dimethylacetamide. The reaction temperature is desirably a boiling point of the solvent.

[Electrophotosensitive Materials]

The electrophotosensitive material of the present invention may be any photosensitive material provided it contains the above-mentioned naphthalenetetracarboxylic acid diimide as an electron-transporting agent and may, for example, be a single dispersion-type photosensitive material containing the electron-transporting agent (ETM) and the charge-generating agent (CGM) in a single photosensitive layer or a laminated-layer photosensitive material having the charge-generating layer (CGL) and the charge-transporting layer (CTL).

The composition of the photosensitive material will now be described.

(1) Charge-Generating Agents

As the charge-generating agent, there can be used, for example, selenium, selenium-tellurium, amorphous silicon, pyrylium salt, azo pigment, disazo pigment, anthanthrone pigment, phthalocyanine pigment, indigo pigment, threne pigment, toluidine pigment, pyrazoline pigment, perylene pigment and quinacridone pigment in one kind or in two or more kinds being mixed together so as to exhibit an absorption wavelength in a desired region.

The following phthalocyanine pigment, perylene pigment and bisazo pigment can be particularly preferably used.

Phthalocyanine pigment such as metal-free phthalocyanine, aluminum phthalocyanine, vanadium phthalocyanine, cadmium phthalocyanine, antimony phthalocyanine, chromium phthalocyanine, copper 4-phthalocyanine, germanium phthalocyanine, iron phthalocyanine, chloroaluminum phthalocyanine, oxotitanyl phthalocyanine, chloroindium phthalocyanine, chlorogallium phthalocyanine, magnesium phthalocyanine, dialkyl phthalocyanine, tetramethyl phthalocyanine, and tetraphenyl phthalocyanine. The crystalline form may be any one of α-type, β-type, γ-type, δ-type, ε-type, σ-type, χ-type or τ-type.

Perylene pigment represented by the general formula (8), (8)

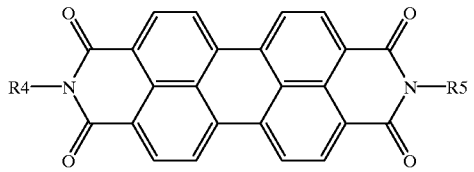

wherein R4 and R5 are each a substituted or unsubstituted alkyl group having not more than 18 carbon atoms, cycloalkyl group, aryl group, alkaryl group or aralkyl group.

Examples of the alkyl group include ethyl group, propyl group, butyl group and 2-ethylhexyl group, examples of the cycloalkyl group include cyclohexyl group and the like group, examples of the aryl group include phenyl group, naphthyl group, examples of the alkaryl group include tolyl group, xylyl group, ethylphenyl group, and examples of the aralkyl group include benzyl group and phenetyl group. Examples of the substituent include alkoxyl group and halogen atom.

Bisazo pigment represented by the following formula (9), $$Cp—N=N—Y—N=N—Cp \quad (9)$$

wherein Y is a divalent aromatic group that may include a heterocyclic group, and Cp is a coupler residue.

As the divalent aromatic group, there can be exemplified benzene, naphthalene, anthracene, phenanthrene, chrysene, anthraquinone, biphenyl, bisphenols, and a divalent group derived from a heterocyclic ring or a combination thereof. As the heterocyclic group, there can be exemplified monocyclic or polycyclic saturated or unsaturated heterocyclic rings having nitrogen, oxygen, sulfur or a combination thereof in the ring. Concrete examples include pyrrole, pyrazole, thiophene, furan, imidazoline, pyrimidine, pyrazoline, pyran, pyridine, benzofuran, benzoimidazoline, benzoxazole, indoline, quinoline, chromene, carbazole, dibenzofuran, xanthene and thioxanthene. These divalent groups may no be substituted or substituted. As the substituent, there can be exemplified alkyl group, aryl group and heterocyclic group. Here, examples of the alkyl group include methyl group, ethyl group, propyl group, butyl group and amyl group; examples of the aryl group include phenyl group, naphthyl group, biphenyl group, anthrile group, phenanthrile group and fluorenyl group; and examples of the substituted heterocyclic group include a monocyclic or polycyclic saturated or unsaturated heterocyclic group containing nitrogen, oxygen, sulfur or a combination thereof in the ring, such as thienyl group, furyl group, imidazolyl group, pyrrolyl group, pyrimidinyl group, imidazole group, pyradinyl group, pyrazolynyl group, pyrrolidinyl group, pyranyl group, piperidyl group, piperazinyl group, morpholyl group, pyridyl group, pyrimidyl group, pyrrolidinyl group, pyrrolinyl group, benzofuryl group, benzimidazolyl group, benzofuranyl group, indolyl group, quinolyl group, carbazolyl group and dibenzofuranyl group.

As the coupler residue in the formula (9), there can be used any residue of the coupler (azo coupling component) used for the azo pigment of this kind, such as substituted or unsubstituted phenols, naphthols or a hydroxyl group-containing heterocyclic ring compound. Here, as the substituent, there can be exemplified lower alkyl group, lower alkoxyl group, aryl group, acyloxyl group, halogen atom such as chloro, hydroxyl group, nitryl group, nitro group, amino group, amide group, acyloxyl group and carboxyl group.

(2) Charge-Transporting Agents

The charge-transporting agent used in the present invention contains the above-mentioned naphthalenetetracarboxylic acid diimide derivative as an electron-transporting agent. The derivative can be used alone as a charge-transporting agent, and can be further used in combination with a positive hole-transporting agent or an electron acceptor. The use in combination makes it possible to further enhance the photosensitivity.

As the positive hole-transporting material, the following compounds have been known and those that exhibit excellent solubility and positive hole-transporting property are selected out of them.

Pyrene,

N-ethylcarbazole,

N-isopropylcarbazole,

N-methyl-N-phenylhydrazino-3-methylindene-9-carbazole,

N,N-diphenylhydrazino-3-methylindene-9-ethylcarbazole,

N,N-diphenylhydrazino-3-methylindene-10-ethylphenothiazine,

N,N-diphenylhydrazino-3-methylindene-10-ethylphenoxazine, p-diethylaminobenzaldehyde-N,N-diphenylhydrazone, p-diethylaminobenzaldehyde-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, 2,5-bis(p-diethylaminophenyl)-1,3,4-oxadiazole, 1-phenyl-3-(p-diethylaminostyryl)-5-(p-diethylaminophenyl)pyrazoline, 1-[quinonyl(2)]-3-(p-diethylaminostyryl)-5-(p-diethylaminophenyl)pyrazoline, 1[-pyridyl(2)]-3-(p-diethylaminostyryl)-5-(p-diethylaminophenyl)pyrazoline, 1-[6-methoxy-pyridyl(2)]-3-(p-diethylaminostyryl)-5(p-diethylaminophenyl)pyrazoline, 1-[pyridyl(3)]-3-(p-diethylaminostyryl)-5-(p-diethylaminophenyl)pyrazolinel-[lepidyl(3)]-3-(p-diethylaminostyryl)-5-(p-diethylaminophenyl) pyrazoline, 1-[pyridyl(2)]-3-(p-diethylaminostyryl)-4-methyl-5(-p-diethylaminophenyl)pyrazoline, 1-[pyridyl(2)]-3-(α-methyl-p-diethylaminostyryl)-3(-p-diethylaminophenyl)pyrazoline, 1-phenyl-3-(p-diethylaminostyryl)-4-methyl-5-(p-diethylaminophenyl)pyrazoline, spiropyrazoline, 2-(p-diethylaminostyryl)-3-diethylaminobenzoxazole, 2-(p-diethylaminophenyl)-4-(p-dimethylaminophenyl)-5-(2-chlorophenyl)oxazole, 2-(p-diethylaminostyryl)-6-diethylaminobenzothiazole, bis(4-diethylamino-2-methylphenyl)phenylmethane, 1,1-bis(4-N,N-diethylamino-2-methylphenyl)heptane, 1,1,2,2-tetrakis(4-N,N-dimethylamino-2-methylphenyl) ethane, N,N'-diphenyl-N,N'-bis(methylphenyl)benzidine, N,N'-diphenyl-N,N'-bis(ethylphenyl)benzidine, N,N'-diphenyl-N,N'-bis(propylphenyl)benzidine, N,N'-diphenyl-N,N'-bis(butylphenyl)benzidine, N,N'-bis(isopropylphenyl)benzidine, N,N'-diphenyl-N,N'-bis(secondary butylphenyl) benzidine, N,N'-diphenyl-N,N'-bis(tertiary butylphenyl)benzidine, N,N'-diphenyl-N,N'-bis(2,4-dimethylphenyl)benzidine, N,N'-diphenyl-N,N'-bis(chlorophenyl)benzidine, triphenylamine, poly-N-vinylcarbazole, polyvinyl pyrene, polyvinyl anthracene, polyvinyl acridine, poly-9-vinylphenyl anthracene, pyrene-formaldehyde resin, and ethylcarbazole formaldehyde resin.

As a preferred positive hole-transporting agent, there can be exemplified aromatic amines represented by the following formula (10), (10)

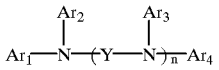

wherein Ar1, Ar2, Ar3 and Ar4 are substituted or unsubstituted aryl groups, Y is a substituted or unsubstituted arylene group, and n is a number of zero or 1.

As another preferred positive hole-transporting agent, there can be exemplified hydrazones and, particularly, hydrazones represented by the following formula (11), (11)

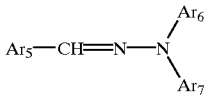

wherein Ar5, Ar6 and Ar7 are substituted or unsubstituted aryl groups.

As the electron acceptor used in combination with the naphthalenetetracarboxylic acid diimide derivative (electron-transporting agent) of the present invention, there can be used any one that has heretofore been used as the electron-transporting agent and, particularly, benzoquinones or naphthoquinones represented by the following formula (12), (12)

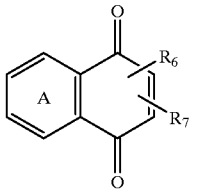

wherein a condensed ring A may be omitted, and R6 and 7 are hydrogen atoms, alkyl groups or acyloxyl groups, such as p-benzoquinone, 2,6-t-butylbenzoquinone, 1,4-naphthoquinone, 2-t-butyl-3-benzoyl-1,4-naphthoquinone, or 2-phenyl-3-benzoyl-1,4-naphthoquinone, and diphenoquinones represented by the following formula (13), (13)

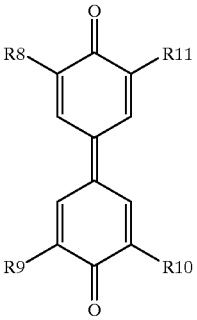

wherein R8, R9, R10, and R11 are alkyl groups, cycloalkyl groups, aryl groups or alkoxyl groups, which may be the same or different such as 3,5-dimethyl-3',5'-di-t-butyldiphenoquinone, 3,5-dimethoxy-3',5'-di-t-butyldiphenoquinone, 3,3'-dimethyl-5,5'-di-t-butyldiphenoquinone, 3,5'-dimethyl-3',5-di-t-butyldiphenoquinone, 3,5,3',5'-tetramethyldiphenoquinone, 2,6,2',6'-tetra-t-butyldiphenoquinone, 3,5,3',5'-tetraphenyldiphenoquinone, or 3,5,3',5'-tetracyclohexyldiphenoquinone.

(3) Binder Resins

As a resin medium for dispersing the charge-generating agent and the charge-transporting agent, there can be used a variety kinds of resins such as olefin polymers like styrene polymer, acrylic polymer, styrene-acrylic polymer, ethylene-vinyl acetate copolymer, polypropylene, and ionomer, and a variety kinds of polymers such as polyvinyl chloride, vinyl chloride-vinyl acetate copolymer, polyester, alkyd resin, polyamide, polyurethane, epoxy resin, polycarbonate, polyarylate, polysulfone, diallyl phthalate resin, silicone resin, ketone resin, polyvinyl butyral resin, polyether resin, phenol resin and photo-curing resins like epoxy acrylate. These binder resins can be used in one kind or in two or more kinds being mixed together. Preferred resins include styrene polymer, acrylic polymer, styrene-acrylic polymer, polyester resin, alkyd resin, polycarbonate and polyarylate.

Particularly preferred resins are a polycarbonate, Panlite manufactured by Teijin Kasei Co., PCZ manufactured by Mitsubishi Gas Kagaku Co., that pertain to a polycarbonate derived from bisphenols and phosgene, the polycarbonate is represented by the following general formula (14), (14)

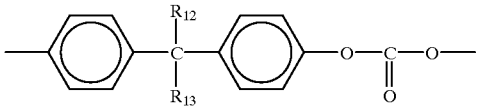

wherein R12 and R13 are hydrogen atoms or lower alkyl groups, and R12 and R13 being coupled together may form a cyclo ring such as a cyclohexane ring together with a carbon atom that is bonded thereto.

[Single-Layer Photosensitive Materials]

In the single-layer dispersion photosensitive material used in the present invention, it is desired that the charge-generating agent (CGM) is contained in the photosensitive layer in an amount of from 1 to 10% by weight and, particularly, from 3 to 5% by weight per the solid component, and that the naphthalenetetracarboxylic acid diimide derivative electron-transporting agent is contained in the photosensitive layer in an amount of from 3 to 100% by weight and, particularly, from 50 to 80% by weight per the solid component.

From the standpoint of photosensitivity and enabling the reversal development to be carried out (broadening the use), furthermore, it is desired to use the naphthalenetetracarboxylic acid diimide derivative electron-transporting agent (ET) and the positive hole-transporting agent (HT) in combination. In this case, the weight ratio of ET:HT is from 10:1 to 1:10 and, particularly, from 1:5 to 1:1.

When the naphthalenetetracarboxylic acid diimide derivative electron-transporting agent and the electron acceptor are used in combination, furthermore, the photosensitivity is further increased. In this case, it is desired that the electron-transporting agent and the electron acceptor are used at a weight ratio of from 1:1 to 10:1 to obtain enhanced photosensitivity by the addition in small amounts.

In the case of a single-layer photosensitive material, the thickness of the photosensitive layer is usually selected to be from 5 to 100 $\mu$m and, particularly, from 10 to 50 $\mu$m from the standpoint of electrophotographic properties.

[Laminated-Layer Photosensitive Materials]

In the case of the laminated-layer photosensitive material, it is desired that the charge-generating agent (CGM) is contained in an amount of from 5 to 1000 parts by weight and, particularly, from 30 to 500 parts by weight per 100 parts by weight of the solid resin component in the charge-generating layer (CGL) and that the naphthalenetetracarboxylic acid diimide electron-transporting agent is contained in an amount of from 0.1 to 40 parts by weight and, particularly, from 0.5 to 20 parts by weight per 100 parts by weight of the solid resin component in the charge-transporting layer (CTL).

In the case of the substrate/CGL/CTL photosensitive material, it is desired that the CGL lies over a range of, usually, from 0.01 to 5 $\mu$m and, particularly, from 0.1 to 3 $\mu$m and that the CTL lies over a range of from 2 to 100 $\mu$m and, particularly, from 5 to 50 $\mu$m.

[Preparation of the Photosensitive Materials]

The composition for forming the photosensitive material used in the present invention can be blended with various blending agents that have been known per se, such as antioxidant, radical-trapping agent, singlet quencher, UV-absorbing agent, softening agent, surface-reforming agent, defoaming agent, filler, viscosity-imparting agent, dispersion stabilizer, wax, acceptor and donor within a range in which they will not adversely affect the electrophotographic properties.

Upon blending at least the upper layer in the photosensitive material with a steric hindrant phenolic antioxidant in an amount of from 0.1 to 50% by weight per the total solid components, furthermore, the durability of the photosensitive material can be markedly improved without adversely affecting the electrophotographic properties.

As the electrically conducting substrate on which the photosensitive layer will be formed, there can be used various materials having electrically conducting property like a simple substance of a metal, such as aluminum, copper, tin, platinum, gold, silver, vanadium, molybdenum, chromium, cadmium, titanium, nickel, indium, stainless steel or brass, or a plastic material on which the above-mentioned metals are deposited or laminated, or a glass coated with aluminum iodide, tin oxide, or indium oxide. The photosensitive material of the present invention preferably employs an ordinary aluminum blank tube and, particularly, an aluminum blank tube coated with an alumite film maintaining a thickness of from 1 to 50 $\mu$m.

To form the photosensitive material, the charge-generating agent, electron-transporting agent and binder resin are used in combination, or the charge-generating agent and binder resin are used in combination, or the electron-transporting agent and binder resin are used in combination, thereby to prepare a coating composition relying upon a widely known method such as using a roll mill, ball mill, Atritor, paint shaker or ultrasonic dispersing device, and the coating composition is applied relying on a known coating means and is, as required, laminated followed by drying.

A variety of organic solvents can be used for forming a coating solution. Examples include alcohols such as methanol, ethanol, isopropanol and butanol; aliphatic hydrocarbons such as n-hexane, octane, and cyclohexane; aromatic hydrocarbons such as benzene, toluene and xylene; halogenated hydrocarbons such as dichloromethane, dichloroethane, carbon tetrachloride and chlorobenzene; ethers such as dimethyl ether, diethyl ether, tetrahydrofurane, ethylene glycol dimethyl ether, and diethylene glycol dimethyl ether; ketones such as acetone, methyl ethyl ketone and cyclohexanone; esters such as ethyl acetate and methyl acetate; and dimethylformamide and dimethylsulfoxide, which can be used in one kind or in two or more kinds being mixed together. The concentration of solid components in the coating solution is usually from 5 to 50%.

There is no particular limitation on the method of forming images by using the electrophotosensitive material of the present invention. Generally, the photosensitive material is electrically charged uniformly and is exposed to image-bearing light to form an electrostatic latent image. The electrostatic latent image is then developed by using a nonmagnetic one-component toner, a magnetic one-component toner, a magnetic two-component developing agent or a nonmagnetic two-component developing agent. The developed image is then transferred onto a transfer paper and is fixed thereby to form an image.

The present invention will now be described by way of Examples.

SYNTHESIS EXAMPLE 1

270 Parts by weight of a naphthalene-1,4,5,8-tetracarboxylic acid dianhydride and 150 parts by weight of a 2-methyl-6-ethylaniline were heated in a dimethylformamide for one hour with refluxing. Then, 100 parts by weight of a 2-ethoxyethylamine was added thereto, and the mixture was heated in the dimethylformamide for another two hours with refluxing. After cooling, the reaction mixture was filtered and the precipitate was washed with the dimethylformamide and, then, with ether, and was dried.

The product was refined to obtain 205 parts by weight of an N-(2-ethoxyethyl)-N'-(2-methyl-6-ethylphenyl) naphthalene-1,4,5,8-tetracarboxylic acid diimide, m.p., 164.5 to 167.5° C.

Figure 2:
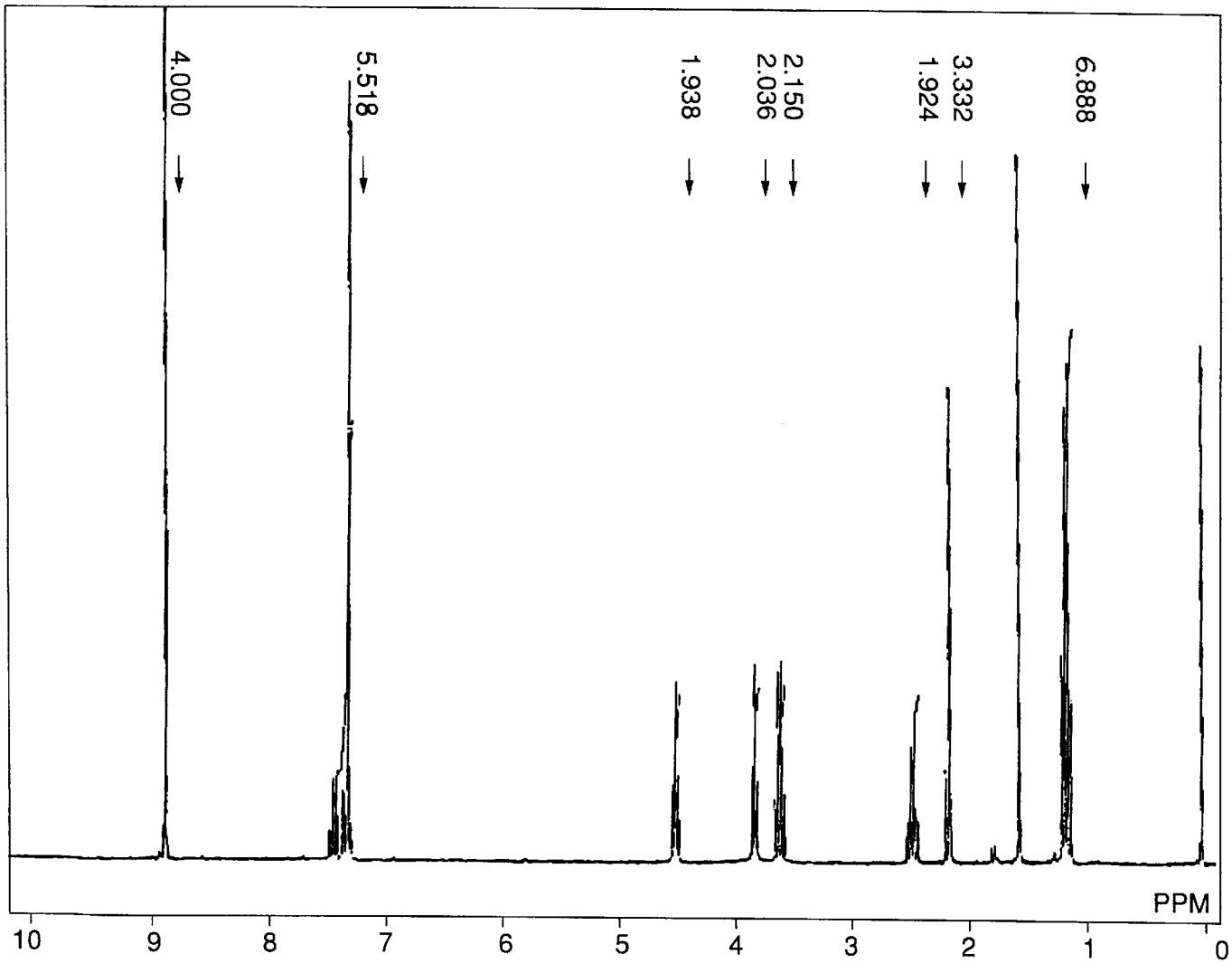
FIG. 2 shows a nuclear magnetic resonance spectrum of the naphthalenetetracarboxylic acid diimide derivative (Synthesis Example 1) according to the present invention.

FIG. 1 shows an infrared-ray absorption spectrum thereof and FIG. 2 shows a nuclear magnetic resonance spectrum (NMR) thereof.

SYNTHESIS EXAMPLE 2

An N-(1,2-dimethylpropyl)-N'-(2-methyl-6-ethylphenyl) naphthalene-1,4,5,8-tetracarboxylic acid diimide, m.p., 207 to 208° C., was synthesized in the same manner as in Synthesis Example 1 but using a 1,2-dimethylpropylamine instead of the 2-ethoxyethylamine used in Synthesis Example 1.

Figure 3:
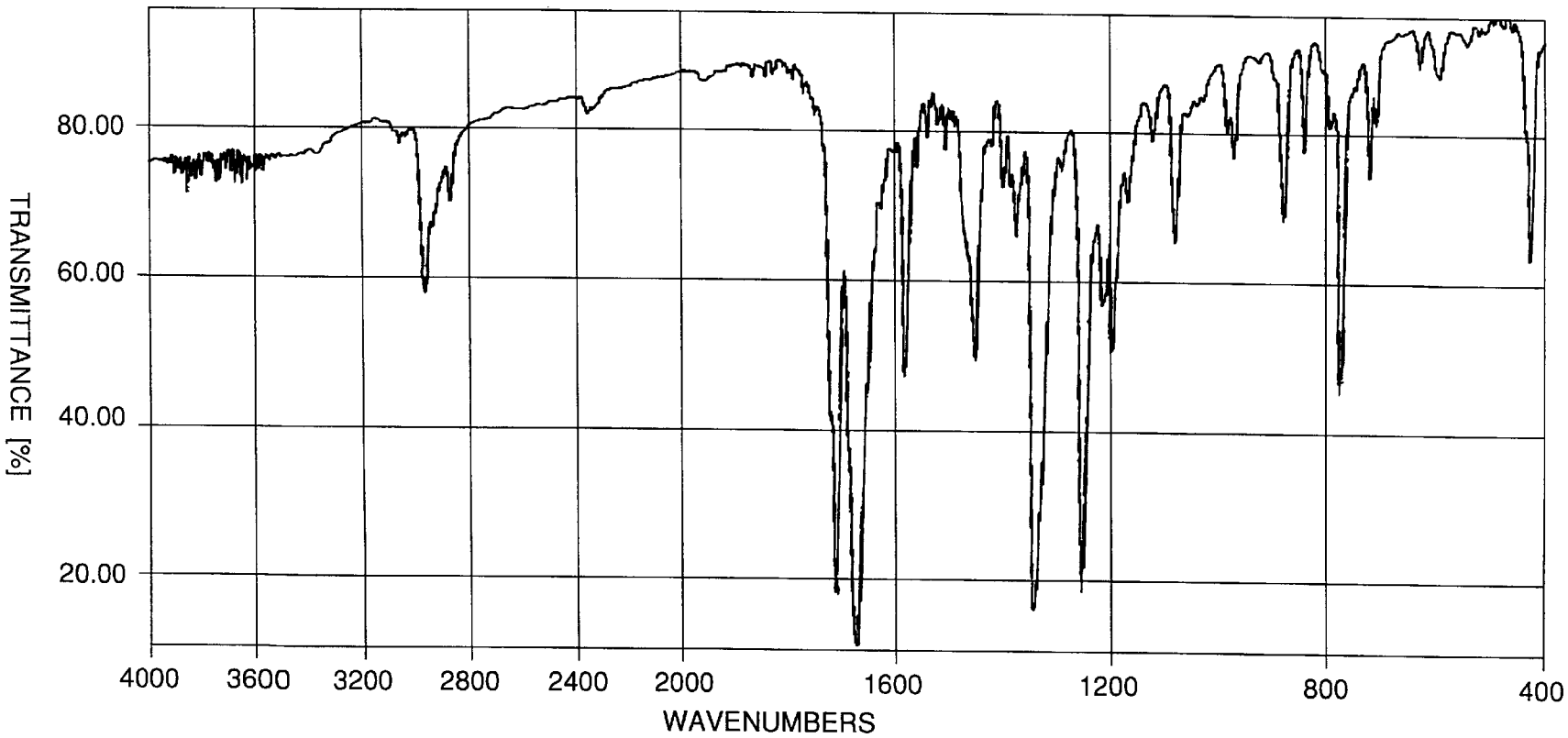
FIG. 3 shows an infrared-ray absorption spectrum of a naphthalenetetracarboxylic acid diimide derivative (Synthesis Example 2) according to the present invention.
Figure 4:
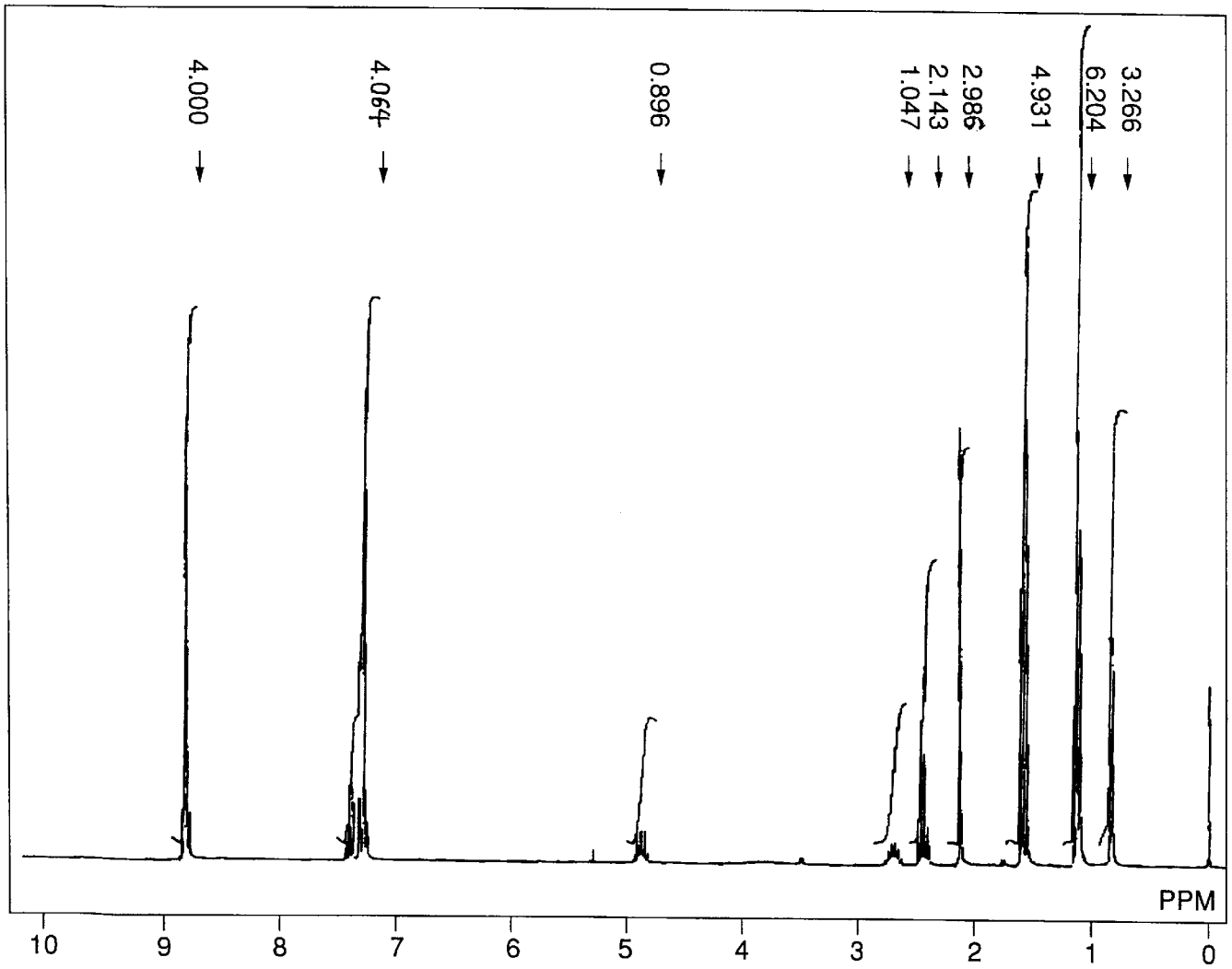
FIG. 4 shows a nuclear magnetic resonance spectrum of the naphthalenetetracarboxylic acid diimide derivative (Synthesis Example 2) according to the present invention.

FIG. 3 shows an infrared-ray absorption spectrum thereof and FIG. 4 shows a nuclear magnetic resonance spectrum (NMR) thereof.

EXAMPLES 1 TO 18 AND COMPARATIVE EXAMPLES 1 TO 9

In Examples, use was made, as an electron-transporting agent, of the naphthalenetetracarboxylic acid diimide derivative of an asymmetrical structure obtained in Synthesis Example 1, i.e., an N-(2-ethoxyethyl)-N'-(2-methyl-6-ethylphenyl)naphthalene-1,4,5,8-tetracarboxylic acid diimide [electron-transporting agent A] represented by the following formula (15), (15)

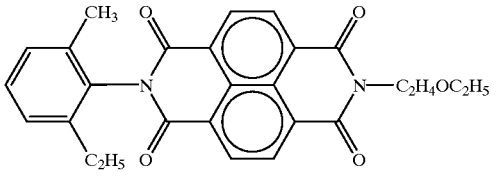

In Comparative Examples, use was made of an N,N'-bis (2-ethoxyethyl)naphthalene-1,4,5,8-tetracarboxylic acid diimide [electron-transporting agent B] represented by the following formula (16) as an electron-transporting agent having a symmetrical structure, (16)

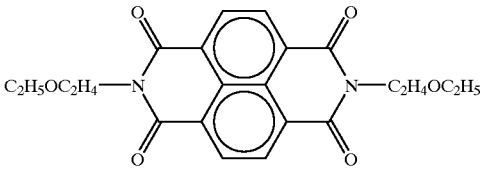

1. Preparation of Photosensitive Material.

(Single-Layer Photosensitive Material)

5 Parts by weight of a pigment shown in Table 1 as a charge-generating agent, 50 parts by weight of a compound shown in Table 1 as a positive hole-transporting agent, the amount shown in Table 1 of a compound shown in Table 1 as an electron-transporting agent, 100 parts by weight of a polycarbonate as a binder agent, and 800 parts by weight of a tetrahydrofuran as a solvent, were mixed and dispersed by using a ball mill for 50 hours to prepare a coating solution for forming a single-layer photosensitive layer. The thus prepared solution was then applied onto an aluminum blank tube and was dried with the hot air heated at 100° C. for 60 minutes to obtain a single-layer photosensitive material for electrophotography having a film thickness of from 15 to 20 $\mu$m.

(Laminated-Layer Photosensitive Material)

100 Parts by weight of a charge-generating agent, 100 parts by weight of a binder resin (polyvinyl butyral) and 2000 parts by weight of a solvent (tetrahydrofuran) were mixed and dispersed by the ball mill for 50 hours to prepare a coating solution for forming a charge-generating layer. The coating solution was then applied onto an aluminum blank tube and was dried with the hot air heated at 100° C. for 60 minutes to prepare a charge-generating layer having a film thickness of 1 $\mu$m.

Furthermore, the amount shown in Table 1 of an electron-transporting agent shown in Table 1, 100 parts by weight of a polycarbonate and 800 parts by weight of a solvent (toluene) were mixed and dispersed by using the ball mill for 50 hours to prepare a coating solution for forming a charge-transporting layer. The coating solution was then applied onto the charge-generating layer, and was dried with the hot air heated at 100° C. for 60 minutes to form a charge-transporting layer having a film thickness of 20 $\mu$m thereby to obtain a laminated-layer photosensitive material.

2. Evaluation.

(1) Method of Evaluating the Photosensitivity (in the case of a phthalocyanine pigment).

By using a drum sensitivity tester, a voltage was applied to the photosensitive materials obtained in Examples and in Comparative Examples to electrically charge them up to +700 V. Then, the photosensitive materials were irradiated on their surfaces with monochromatic light of 780 nm (half-value width, 20 nm) through a band-pass filter for a predetermined period of time, and the degrees of attenuation of the potential were observed to measure the electrophotographic properties.

Source of light: halogen lamp

Intensity of light: 16 $\mu$w/cm$^2$ (780 nm)

Irradiation time: 80 msec

Measurement of potential after exposed to light: 330 msec after the start of the exposure to light The results were as shown in Table 1.

In Table 1, the column Vr (V) shows surface potentials of the photosensitive materials 330 milliseconds after the start of the exposure to light.

(2) Method of Evaluating the Photosensitivity (in the case of a perylene pigment).

By using a drum sensitivity tester, a voltage was applied to the photosensitive materials obtained in Examples and in Comparative Examples to electrically charge them up to +700 V. Then, the photosensitive materials were irradiated on their surfaces with white light from a halogen lamp for a predetermined period of time, and the degrees of attenuation of the potential were observed to measure the electrophotographic properties.

Source of light: halogen lamp

Intensity of light: 147 $\mu$W/cm$^2$

Irradiation time: 50 msec

Measurement of potential after exposed to light: 330 msec after the start of the exposure to light The results were as shown in Table 1.

In Table 1, the column Vr (V) shows surface potentials of the photosensitive materials 330 milliseconds after the start of the exposure to light.

TABLE 1

| | Charge-generating agent | Positive hole-trans agent | Electron-transporting agent (parts by wt.) | Electron acceptor | Vr (V) | Remarks |
|---|---|---|---|---|---|---|
| Ex. 1 | $PcH_2$ | yes | A (30) | — | 180 | |
| Ex. 2 | PcTiO | yes | A (30) | — | 195 | |
| Ex. 3 (laminate) | $PcH_2$ | no | A (100) | — | 260 | |
| Ex. 4 | perylene type | yes | A (30) | — | 198 | |
| Ex. 5 (laminate) | perylene type | no | A (100) | — | 290 | |
| Ex. 6 | $PcH_2$ | yes | A (30) | a | 135 | |
| Ex. 7 | $PcH_2$ | yes | A (30) | b | 134 | |
| Ex. 8 | $PcH_2$ | yes | A (30) | c | 130 | |
| Ex. 9 | $PcH_2$ | yes | A (30) | d | 125 | |
| Ex. 10 | $PcH_2$ | yes | A (50) | — | 158 | |
| Ex. 11 | PcTiO | yes | A (50) | — | 159 | |
| Ex. 12 (laminate) | $PcH_2$ | no | A (120) | — | 240 | |
| Ex. 13 | perylene type | yes | A (50) | — | 173 | |
| Ex. 14 (laminate) | perylene type | no | A (120) | — | 270 | |
| Ex. 15 | $PcH_2$ | yes | A (50) | a | 115 | |
| Ex. 16 | $PcH_2$ | yes | A (50) | b | 115 | |
| Ex. 17 | $PcH_2$ | yes | A (50) | c | 112 | |
| Ex. 18 | $PcH_2$ | yes | A (50) | d | 107 | |
| Comp. Ex. 1 | $PcH_2$ | yes | B (30) | — | 248 | crystallized |
| Comp. Ex. 2 | PcTiO | yes | B (30) | — | 245 | crystallized |
| Comp. Ex. 3 (laminate) | $PcH_2$ | no | B (100) | — | 345 | crystallized |
| Comp. Ex. 4 | perylene type | yes | B (30) | — | 296 | crystallized |
| Comp. Ex. 5 (laminate) | perylene type | no | B (100) | — | 375 | crystallized |
| Comp. Ex. 6 | $PcH_2$ | yes | B (30) | a | 245 | crystallized |
| Comp. Ex. 7 | $PcH_2$ | yes | B (30) | b | 242 | crystallized |
| Comp. Ex. 8 | $PcH_2$ | yes | B (30) | c | 237 | crystallized |
| Comp. Ex. 9 | $PcH_2$ | yes | B (30) | d | 230 | crystallized |

a: p-benzoquinone
b: 2,6-di-t-butylbenzoquinone
c: 3,5-dimethyl-3',5'-di-t-butyl-4,4'-diphenoquinone
d: 3,3',5,5'-tetra-t-butyl-4,4'-diphenoquinone
$PcH_2$: metal-free phthalocyanine
$PcTiO_2$: oxotitanyl phthalocyanine

EXAMPLES 19 to 36

In Examples 19 to 36, use was made of the naphthalene-tetracarboxylic acid diimide having an asymmetric structure obtained in Synthesis Example 2, i.e., an N-(1,2-dimethylpropyl)-N'-(2-methyl-6-ethylphenyl)naphthalene-1,4,5,8-tetracarboxylic acid diimide [electron-transporting agent A'] expressed by the following formula (17), (17)

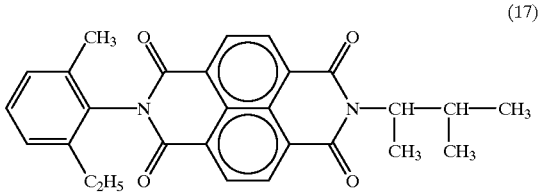

instead of the electron-transporting agent A used in Examples 1 to 18.

The results were as shown in Table 2 below.

TABLE 2

| | Charge-generating agent | Positive hole-trans agent | Electron-transporting agent (parts by wt.) | Electron acceptor | Vr (V) | Re-marks |
|---|---|---|---|---|---|---|
| Ex. 19 | $PcH_2$ | yes | A' (30) | — | 182 | |
| Ex. 20 | PcTiO | yes | A' (30) | — | 196 | |
| Ex. 21 (laminate) | $PcH_2$ | no | A' (100) | — | 261 | |
| Ex. 22 | perylene type | yes | A' (30) | — | 200 | |
| Ex. 23 (laminate) | perylene type | no | A' (100) | — | 290 | |
| Ex. 24 | $PcH_2$ | yes | A' (30) | a | 136 | |
| Ex. 25 | $PcH_2$ | yes | A' (30) | b | 134 | |
| Ex. 26 | $PcH_2$ | yes | A' (30) | c | 131 | |
| Ex. 27 | $PcH_2$ | yes | A' (30) | d | 126 | |
| Ex. 28 | $PcH_2$ | yes | A' (50) | — | 158 | |
| Ex. 29 | PcTiO | yes | A' (50) | — | 160 | |
| Ex. 30 (laminate) | $PcH_2$ | no | A' (120) | — | 240 | |
| Ex. 31 | perylene type | yes | A' (50) | — | 175 | |
| Ex. 32 (laminate) | perylene type | no | A' (120) | — | 270 | |
| Ex. 33 | $PcH_2$ | yes | A' (50) | a | 116 | |
| Ex. 34 | $PcH_2$ | yes | A' (50) | b | 115 | |
| Ex. 35 | $PcH_2$ | yes | A' (50) | c | 113 | |
| Ex. 36 | $PcH_2$ | yes | A' (50) | d | 108 | |

What is claimed is:

1. An electrophotography photosensitive material containing naphthalenetetracarboxylic acid diimide represented by the formula (1), (1)

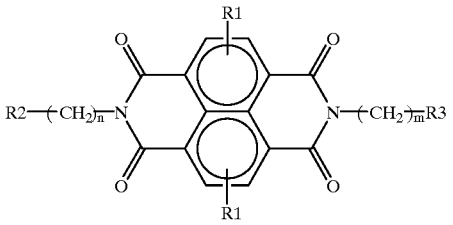

wherein m and n are integers inclusive of 0 but not larger than 6, and are different from each other, R1 is a hydrogen atom, an alkyl group having 1 to 6 carbon atoms, including the number of carbon atoms contained in the methylene groups bonded to the nitrogen atoms, an alkoxyl group having 1 to 6 carbon atoms, or a halogen atom, either one of R2 or R3 is a substituted or unsubstituted aryl group, and the other one is an alkyl group, an alkoxyl group or an amino group selected from the group consisting of methylamino group, ethylamino group, N-ethylamino-ethylamino group, diamino group and diethylamino group, and wherein when R2 or R3 is an alkoxyl group or an amino group, the number n or m of methylene chains to which this group is bonded is not zero.

2. An electrophotography photosensitive material containing naphthalenetetracarboxylic acid diimide according to claim 1, wherein said aryl group is directly bonded to a nitrogen atom.

3. An electrophotography photosensitive material containing naphthalenetetracarboxylic acid diimide according to claim 1, wherein said aryl group is a phenyl group.

4. An electrophotography photosensitive material containing naphthalenetetracarboxylic acid diimide according to claim 1, wherein either one of said R2 or R3 is an aryl group, and the other one is an alkyl group having 1 to 6 carbon atoms as a group containing a methylene group bonded to the nitrogen atom.

5. An electrophotography photosensitive material containing naphthalenetetracarboxylic acid diimide according to claim 1, wherein either one of said R2 or R3 is an aryl group, and the other one is a secondary or tertiary amino group.

6. An electrophotography photosensitive material containing naphthalenetetracarboxylic acid diimide derivatives according to claim 5, wherein the number n or m of methylene chains bonded to said amino group is an integer which is not smaller than 2.

7. An electrophotography photosensitive material containing naphthalenetetracarboxylic acid diimide according to claim 1, wherein either one of said R2 or R3 is an aryl group, and the other one is an alkoxyl group having 1 to 6 carbon atoms.

8. An electrophotography photosensitive material containing naphthalenetetracarboxylic acid diimide according to claim 7, wherein the number n or m of methylene chains bonded to said alkoxyl group is an integer which is not smaller than 2.

9. An electrophotography photosensitive material according to claim 1, further containing an electron acceptor.

10. An electrophotography photosensitive material containing naphthalenetetracarboxylic acid diimide represented by the formula (1), (1)

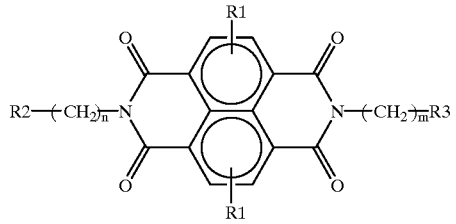

wherein m and n are integers inclusive of 0 but not larger than 6, and are different from each other, R1 is a hydrogen atom, and alkyl group having 1 to 6 carbon atoms, an alkoxyl group having 1 to 4 carbon atoms or a halogen atom, either one of R2 or R3 is a substituted or unsubstituted aryl group selected from phenyl and naphthyl, and the other one is an alkyl group having 1 to 6 carbon atoms, an alkoxyl group having 1 to 6 carbon atoms or an amino group selected from secondary and tertiary amines, and wherein when R2 or R3 is an alkoxyl group or an amino group, the number n or m of methylene chains to which this group is bonded is not zero.

11. An electrophotography photosensitive material according to claim 10, further containing an electron receptor.

12. An electrophotography photosensitive material according to claim 10 containing naphthalenetetracarboxylic acid diimide having the formula N-(2-ethoxyethyl)-N'-(2-methyl-6-ethylphenyl)naphthalene-1,4,5,8-tetracarboxylic acid diimide.

13. An electrophotography photosensitive material according to claim 10 containing naphthalenetetracarboxylic acid diimide having the formula N-(1,2-dimethylpropyl)-N'-(2-methyl-6-ethyl-phenyl)naphthalene-1,4,5,8-tetracarboxylic acid diimide.

14. An electrophotography photosensitive material according to claim 10 containing naphthalenetetracarboxylic acid diimide having the formula N-(2-ethoxymethyl)-N'-(2-methyl-6-ethylphenyl)naphthalene-1,4,5,8-tetracarboxylic acid diimide.

15. An electrophotography photosensitive material according to claim 10 containing naphthalenetetracarboxylic acid diimide having the formula N-(2-ethoxyethyl)-N'-phenylnaphthalene-1,4,5,8-tetracarboxylic acid diimide.

16. An electrophotography photosensitive material according to claim 10 containing naphthalenetetracarboxylic acid diimide having the formula N-(2-ethoxyethyl)-N'-(2,6-dimethyl-4-ethylphenyl)naphthalene-1,4,5,8-tetracarboxylic acid diimide.

17. An electrophotography photosensitive material according to claim 10 containing napthalenetetracarboxylic acid diimide having the formula N-(2-ethoxyethyl)-N'-(2-methyl-4-t-butylphenyl)naphthalene-1,4,5,8-tetracarboxylic acid diimide.

18. An electrophotography photosensitive material according to claim 10 containing naphthalenetetracarboxylic acid diimide having the formula N-(dimethylaminoethyl)-N'-(2-methyl-6-ethylphenyl)naphthalene-1,4,5,8-tetracarboxylic acid diimide.

19. An electrophotography photosensitive material according to claim 10 containing naphthalenetetracarboxylic acid diimide having the formula N-(diethylaminoethyl)-N'-(2-methyl-6-ethylphenyl)naphthalene-1,4,5,8-tetracarboxylic acid diimide.

20. An electrophotography photosensitive material according to claim 10 containing naphthalenetetracarboxylic acid having the formula N-(2-ethylhexyl)-N'-(2-methyl-6-ethylphenyl)naphthalene-1,4,5,8-tetracarboxylic acid diimide.

21. An electrophotography photosensitive material according to claim 10 containing naphthalenetetracarboxylic acid having the formula N-amyl-N'-(2-methyl-6-ethylphenyl)naphthalene-1,4,5,8-tetracarboxylic acid diimide.

* * * * *